United States Patent [19]

Frank

[11] Patent Number: 4,480,406

[45] Date of Patent: Nov. 6, 1984

[54] SKYLIGHT

[75] Inventor: Wilhelm Frank, Leinfelden, Fed. Rep. of Germany

[73] Assignee: Wilh. Frank GmbH, Leinfelden-Echterdingen, Fed. Rep. of Germany

[21] Appl. No.: 407,257

[22] Filed: Aug. 11, 1982

[51] Int. Cl.[3] ..... E05D 15/48

[52] U.S. Cl. ..... 49/153; 49/192; 49/390

[58] Field of Search ..... 52/72, 200; 49/390, 49/379, 386, 153, 192

[56] References Cited

U.S. PATENT DOCUMENTS 3,721,044 3/1973 Kvasnes ..... 49/248
4,055,024 10/1977 Frank ..... 49/390
4,217,732 8/1980 Reichstadt ..... 149/386

FOREIGN PATENT DOCUMENTS 597967 12/1925 France ..... 49/386

*Primary Examiner*—Henry E. Raduazo
*Attorney, Agent, or Firm*—Kurt Kelman

[57] ABSTRACT

In skylights wherein the wing may be selectively adjusted into a pivoting and swivel position, the wing is fixed with respect to the auxiliary frame in the pivoted opened position. If this fixation is removed due to a faulty operation, the upper, heavier half of the wing moves in the direction of the case so that there is a danger of damage. To make the negative effects of the faulty operation ineffective, flap 18 provided with latch 19 and having a pivoting axis displaced in relation to axial pin 7 in the direction of swivel joint 5 is pivotally mounted on auxiliary frame 2. Latch 19 arranged at a slight distance from axial pin 7 in the closed position subtends axial pin 7 when wing 3 is pivoted open. In case of a faulty operation, the weight of wing 3 causes axial pin 7 to be pressed against latch 19 of flap 18. This automatically secures a pivotally opened skylight against the results of a faulty operation, which is automatically undone, FIG. 4, when the wing is brought into the closed position.

5 Claims, 4 Drawing Figures

SKYLIGHT

Figure 1:
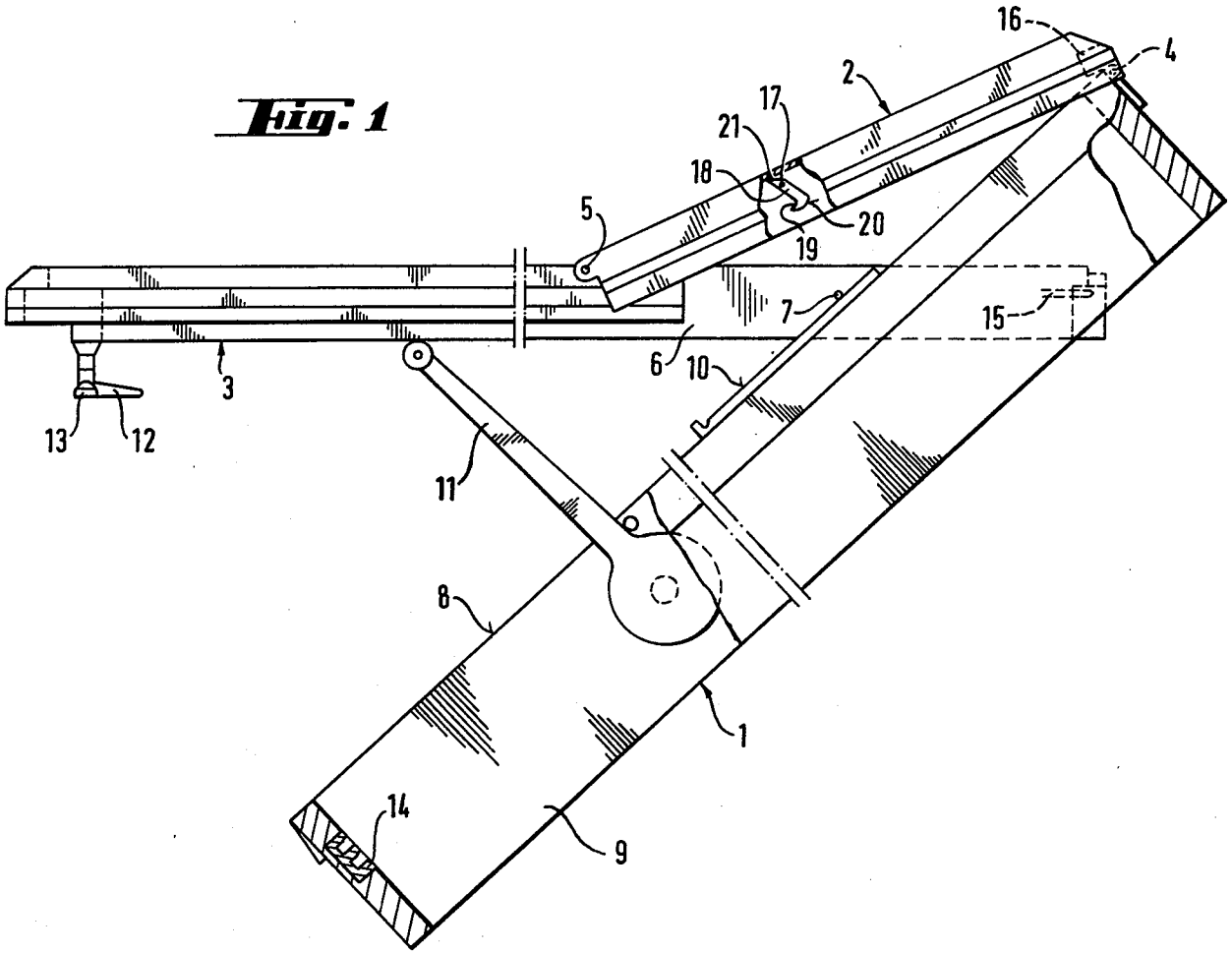

The invention relates to a skylight whose wing is connected with a case by means of an auxiliary frame, the wing being supported on the auxiliary frame by means of a swivel joint and the auxiliary frame being supported on the upper edge of the case by means of a hinged joint, with a locking device for positioning the wing in relation to the auxiliary frame and for locking the wing with respect to the case, with axial pins arranged on the lateral struts of the wing between the swivel and hinged joints, the axial pins being positioned on the end face of the lateral legs of the case in the swing position of the wing.

Such a skylight, known from U.S. Pat. No. 4,055,024, has the advantage that the wing may be selectively opened by the hinged or swivel joint. In the closed position, the wing is locked at the lower edge to the case and is fixedly positioned with respect to the auxiliary frame. To move the wing into a hinged position, the wing/case lock must be undone and the lower edge of the wing must be lifted so that it will move, together with the auxiliary frame, about the hinged joint. If the wing is to be brought into a swivel opening position, the lock wing/case as well as the lock wing/auxiliary frame must be undone, starting from the closing position. When the wing is raised, the angle between the auxiliary frame and the wing increases. The wing swings with the auxiliary frame about the swivel joint, the two axial pins arranged supported on both sides of the wing on the end face of the case gliding therealong and thereby raising the swivel joint on the auxiliary frame from the case so that the swivel axis co-formed by the axial pins is arranged above the center of the wing in the swinging opening. The lifting of the wings is facilitated by a spring-biased opening arm. The locking device is constituted by an operating handle arranged at the lower edge of the wing and a switching lever arranged at the upper edge of the wing, which are not interconnected in a motion-transmitting manner. If an undesired unlocking of the wing with respect to the auxiliary frame occurs by the accidental operation of the switching lever in the hinged opening of the wing, the wing no longer is positioned parallel to the auxiliary frame and, because of the greater weight of the upper wing half, the axial pins engage the end faces of the case and, therefore, this faulty operation could lead to a danger of damage. To make such a faulty operation resulting from the hinged opening position more difficult, the switching lever has been equipped with a locking latch in practice so that an undesired faulty operation was avoided. However, a faulty operation was still possible with some manipulation.

Within the framework of simplifying the operation, the tendency has been to provide a single operation, i.e. to effect the locking wing/case as well as the fixation of the wing with respect to the auxiliary frame with a single operating handle. In a single-handle operation, wherein the operating handle is preferably arranged on the lower edge of the wing, the operating handle may still be accidentally operated in the hinged position of the wing so that the fixation of the wing on the auxiliary frame is accidentally undone and the wing moves down with its upper half and impacts with the axial pins on the end faces of the case.

Therefore, the task is to improve a skylight of this type so that the fixation of the wing on the auxiliary frame is maintained despite an accidentally faulty operation in the hinged position. This task is solved according to the invention by pivotally arranging a flap provided with a latch on the auxiliary frame and providing the free end of the flap with an abutment wedge which is supported on the end face of the case between the axial pin and the hinged joint in the closing position, and the latch is coupled to the axial pin when the axial pin is lifted off the end face of the case.

The fixation of the wing with respect to the auxiliary frame is secured in the hinged position by means of a flap pivotally supported on the auxiliary frame, in cooperation with the axial pin on the side of the wing, which thereby assumed an additional function. In the closing position of the wing, the abutment wedge of the flap adjacent the end face of the case is somewhat above the axial pin with the latch, that is, close to the axial pin in the range between the axial pin and the hinged joint of the auxiliary frame. The pivoting axis of the flap is displaced in relation to the axial pin in the direction of the swivel joint, that is, below the axial pin. The flap is arranged at an acute angle with respect to the end face of the case. The flap and the axial pin have no influence on each other in the closing position of the wing.

If the wing is unlatched from the case to adjust the flap opening while the wing is affixed with respect to the auxiliary frame and the wing is then lifted, the flap glides down in the direction of the axial pin because of its predetermined linkage and its own weight. Beginning with a predetermined opening angle of the flap, the flap is loosely adjacent the axial pin which is then subtended by the latch. If the wing is accidentally unlatched from the auxiliary frame in the opened position of the flap, the upper, heavier part of the wing can move down only a little bit by the movement of the wing about the swivel joint on the auxiliary frame since this downward movement is stopped by the latch of the flap. The wing is then supported on the latch of the flap above the axial pins, a portion of the weight of the wing being effective at this point and pressing the flap so firmly against the axial pin, because of the selected arrangement of the pivoting axis of the flap, that an undesired unlatching of this safety arrangement cannot occur. When the wing is closed again, the abutment wedge first moves into abutment with the end face of the case and the flap is pressed away from the axial pin in the direction of the hinged joint because of the displaced arrangement of the pivoting axis. This happens independently of whether the closing movement is made starting with the faulty operation or only after the faulty operation has been terminated. Thus, the flap results in an automatically effective safety arrangement which eliminates the negative effects of a faulty operation in the hinged position by accidental unlatching of the wing from the auxiliary frame, and additionally is automatically moved out of its securing position. This safety arrangement thereby makes it possible to use an advantageous one-handle operation.

The wing must first be unlatched from the auxiliary frame for the swivelled opening of the wing. The axial pins glide downwards on the end face of the case when the flap is lifted to begin the opening movement, the swivel joints being simultaneously moved away from the case in an angular movement about the hinged joint. Since the flap and the axial pins thereby move apart from the beginning, no interference whatsoever of the pivoting opening movement of the wing by the flap is encountered.

To limit the pivotal movement of the flap on the auxiliary frame, it is advantageous to provide the flap with an abutment face effective in relation to the auxiliary frame. This avoids the possibility of the flap contacting the case below the axial pin, that is, between the axial pin and the swivel joint, for example when the pivotally opened wing is closed, which could lead to jamming.

Since the proper weight is essential for the functioning of the flap, it is advantageous to constitute the pivoting axis by a setbolt which may be riveted to the auxiliary frame, for example, and to support the flap readily movably on the setbolt. An accurate guidance of the flap may also be obtained with a setbolt.

In an advantageous embodiment, the flap is made of synthetic resin so that it may be manufactured cheaply, for example, as a die-cast part.

Figure 2:
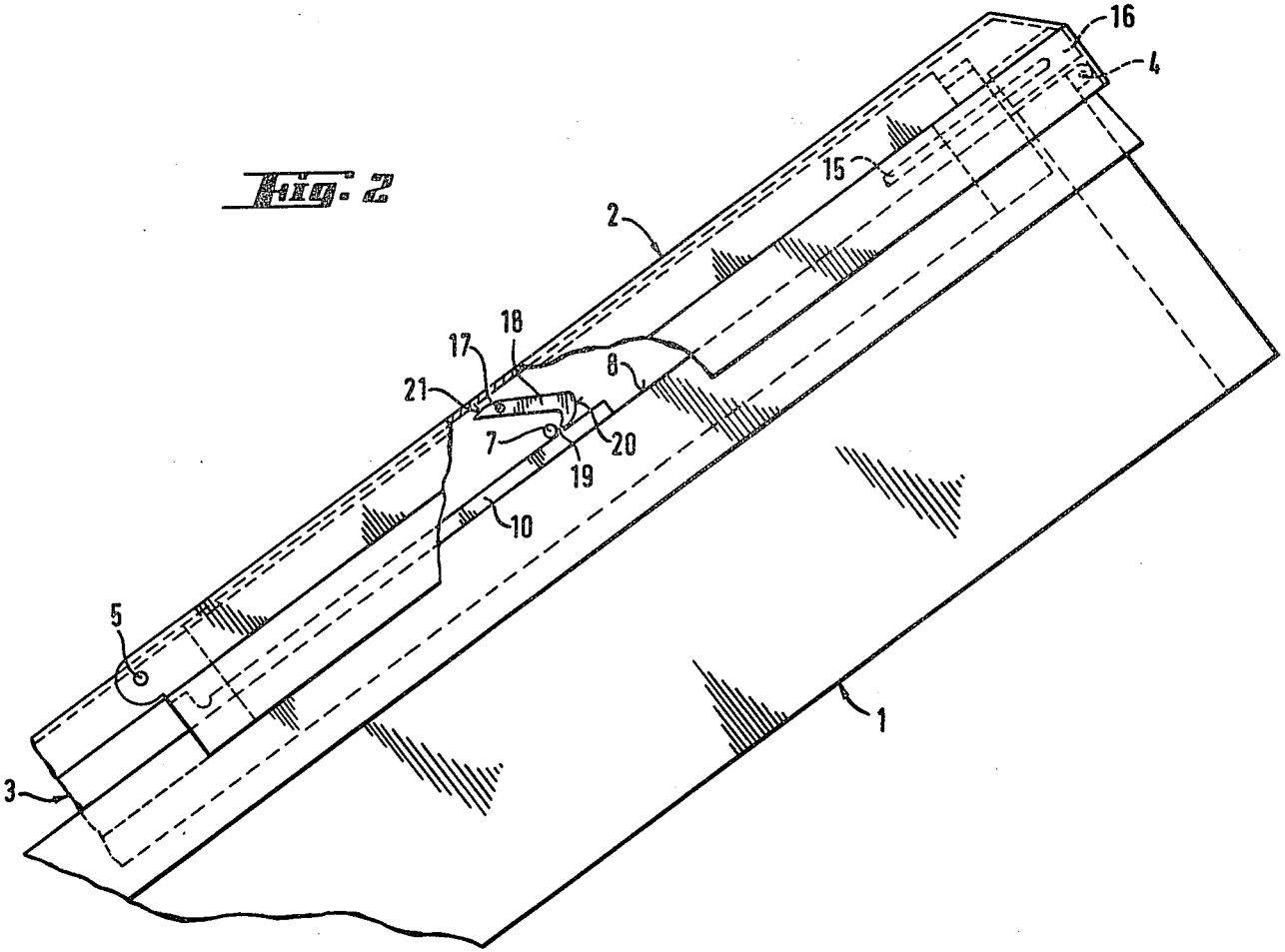
Figure 3:
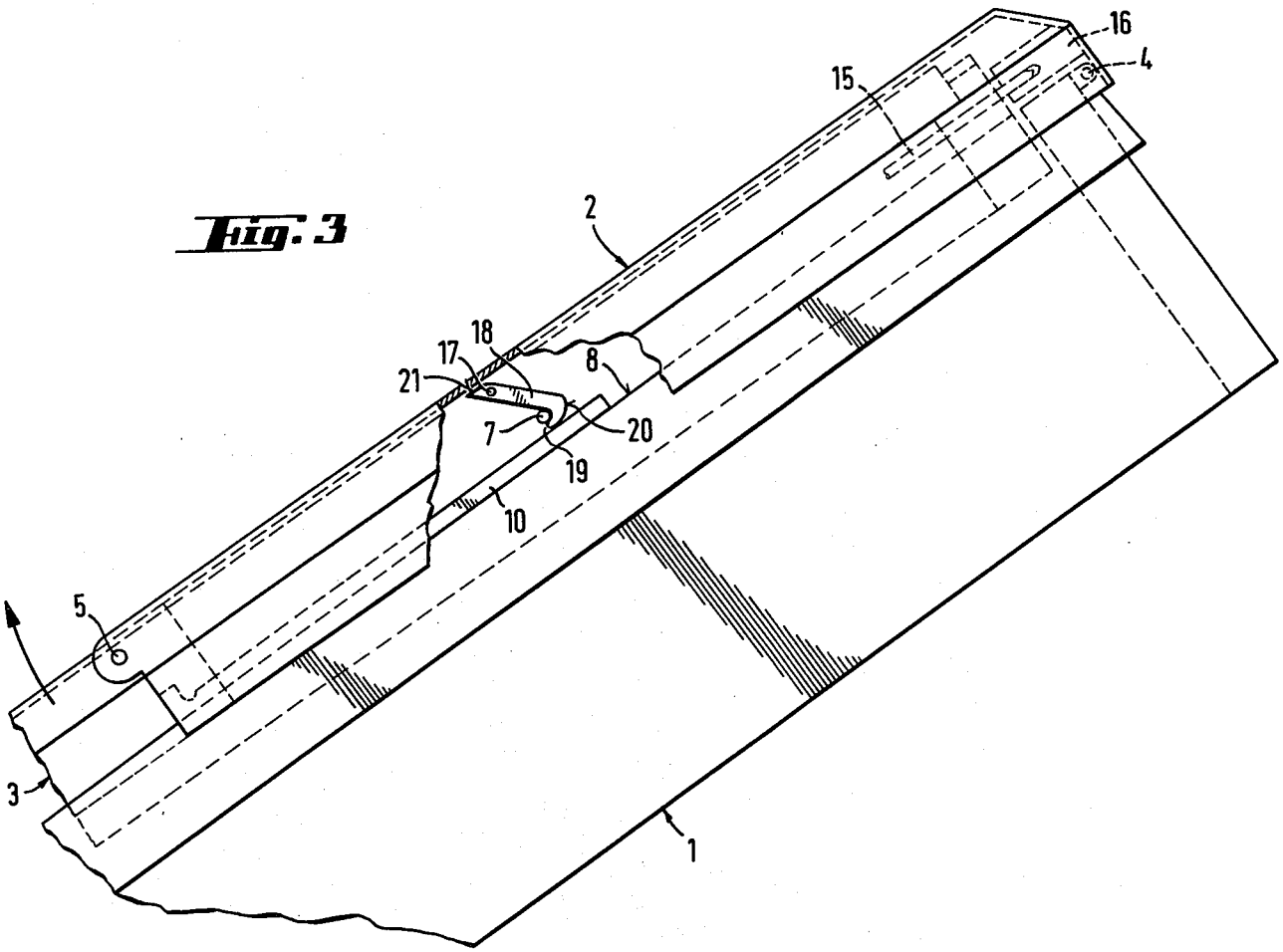
Figure 4:
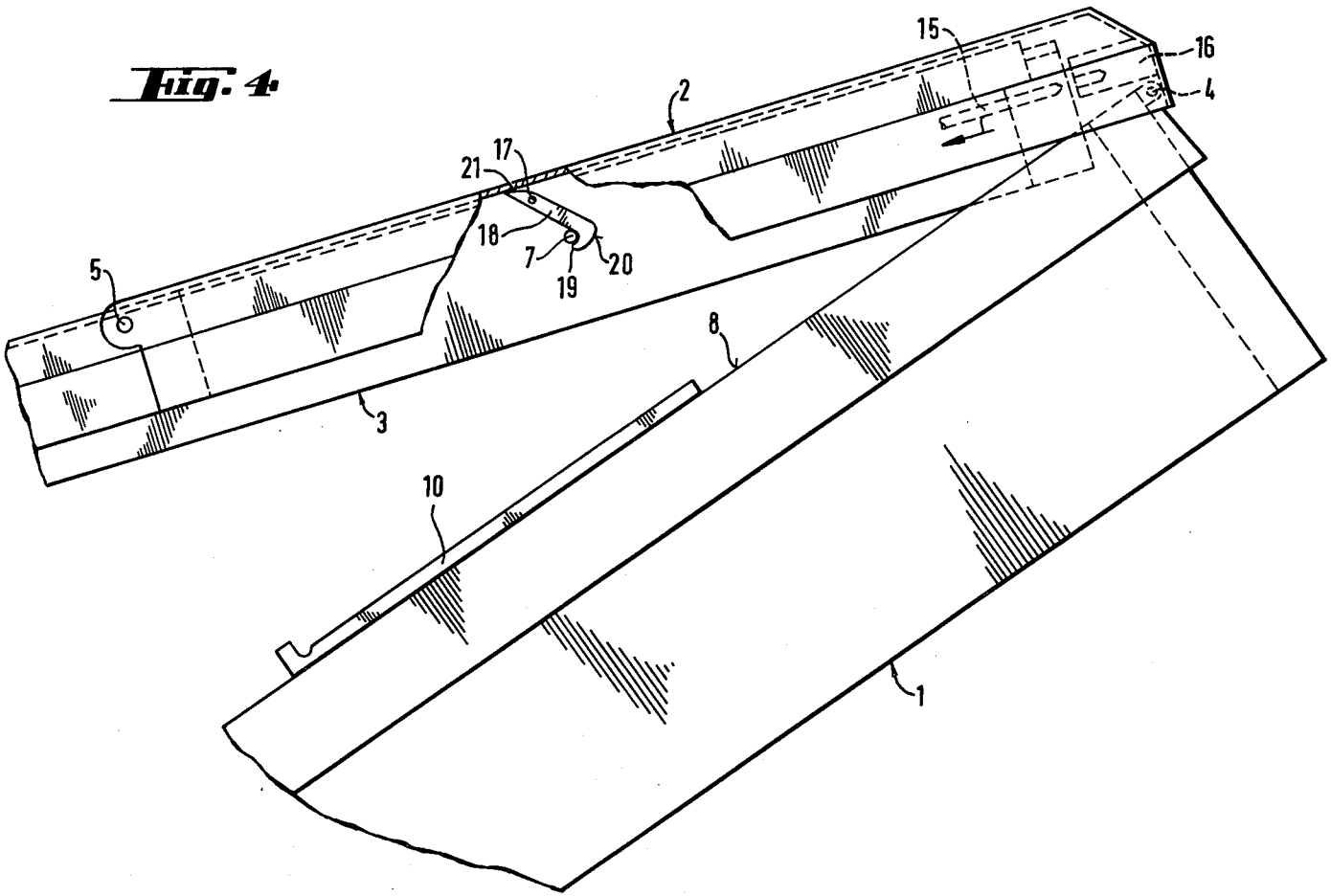

Further advantages and details of the invention may be gleaned from the drawings which show a preferred embodiment in a schematic illustration. In the drawing, FIG. 1 shows a skylight with a pivotally opened wing and a flap on the auxiliary frame, FIG. 2 shows a portion of the skylight according to FIG. 1 on an enlarged scale and in the closed position of the wing, FIG. 3 shows the skylight according to FIG. 2 at the beginning of the hinge opening movement of the wing and FIG. 4 shows this skylight at the end of the hinge opening movement of the wing and with a faulty operation.

The skylight is comprised essentially of case 1 to which wing 3 is linked by means of auxiliary frame 2. Auxiliary frame 2 is connected by hinged joint 4 to the upper edge of case 1 and by swivel joint 5 to wing 3. Lateral braces 6 of wing 3 each carry an axial pin 7 in the range between swivel joint 5 and hinged joint 4, each being supported in the pivoted position of wing 3 on guide rail 10 positioned on end face 8 of lateral leg 9 of case 1. Spring-biased opening arm 11 is arranged on lateral leg 9 for balancing the weight of wing 3 and biases the same between swivel joint 5 and the lower edge of wing 3. Operating handle 12 serves to lock wing 3 against case 1 in the closed position and engages lock part 14 on the case with tongue 13. The locking device for fixing wing 3 in relation to auxiliary frame 2 is constituted by adjusting linkage 15 built into wing 3 and acuatable by operating handle 12 to engage latch housing 16 affixed to auxiliary frame 2.

Setbolt 17 is riveted to the inside of auxiliary frame 2 and flap 18 made of synthetic resin is loosely pivotally mounted thereon. Setbolt 17 forming the pivoting axis for flap 18 is arranged displaced in relation to axial pin 7 at the side of the wing in the direction of swivel joint 5, as can be seen especially in FIG. 2 where wing 3 is in the closed position. Flap 18 has latch 19 and run-up wedge 20 at the free end. At the opposite end, flap 18 is provided with abutment face 21.

In the closed position, wing 3 contacts guide rail 10 for axial pin 7 with its run-up wedge 20. A small spacing remains between axial pin 7 and flap 18.

When the lock between wing 3 and case 1 is undone by a 90°-pivoting of operating handle 12 while wing 3 remains in fixed relationship to auxiliary frame 2 by engagement of adjusting linkage 15 in lock housing 16 and wing 3 is moved up, the wing is pivoted during opening about hinged joint 4. Axial pin 7 moves about an arc which starts at hinged joint 4 and is raised by guide rail 10. This results in an enlargement of the opening angle between wing 3 and end face 8 of case 1; also, an enlargement of the distance of the pivoting axis of flap 18 from this end face 8. Due to its own weight, flap 18 with run-up wedge 20 glides down along guide rail 10 and latch 19 subtends axial pin 7, as shown in FIG. 3.

As wing 3 is opened further to the end pivoted opening position according to FIG. 4, axial pin 7 remains subtended by latch 19 of flap 18. If a faulty operation is accidentally performed in this pivoted open position of wing 3 by an additional pivoting of operating handle 12, causing adjusting linkage 15 to be disengaged from lock housing 16 whereby the fixation of wing 3 with respect to auxiliary frame 2 is removed, wing 3 is slightly lowered at its upper edge, moving about swivel joint 5, i.e. by forming an angle between auxiliary frame 2 and wing 3. This lowering is negligible since axial pin 7 immediately is engaged by latch 19. Therefore, after a faulty operation, flap 18 takes over the function of fixing wing 3 in relation to auxiliary frame 2 in cooperation with axial pin 7.

During the closing movement of wing 3, run-up wedge 20 contacts guide rail 10 and flap 18 is forced to pivot upwardly and resumes the positioning illustrated in FIG. 2 because of the predetermined linkage of flap 18 to auxiliary frame 2 and the presence of run-up wedge 20.

When wing 3 is brought from the closing position into the pivoting position, with the unlatching of wing 3 from auxiliary frame 2, axial pin 7 moves down on guide rail 10 and thus away from flap 18 at the beginning of the opening. Flap 18 has abutment face 21 cooperating with the inside of auxiliary frame 2 to avoid that the flap assumes a dead point position with respect to axial pin 7.

I claim:

1. A skylight comprising (a) a case having lateral legs and an upper edge connecting the lateral legs, the lateral legs defining respective end faces, (b) a wing having lateral struts adjacent the lateral legs of the case, (c) an auxiliary frame supporting the wing on the case for pivoting between a closed and a swing position in relation to the end faces of the case, (d) a swivel joint connecting the wing to the auxiliary frame, (e) a hinged joint connecting the auxiliary frame to the upper edge of the case, the joints enabling the wing to be pivoted between the closed and swing positions, (f) a locking device operative to position the wing in relation to the auxiliary frame and to lock the wing to the case in the closed position, (g) pins fastened to, and projecting from, the lateral struts of the wing, the pins being arranged between the swivel and hinged joints, and the pins engaging the end faces of the lateral legs of the case in the closed position of the wing, (h) flaps pivotally arranged on the auxiliary frame for engagement with, and disengagement from, the pins, and (i) a respective pivot displaced in relation to a respective one of the pins in the direction of the swivel joint and permitting free pivoting of a respective one of the flaps about the pivot, (1) the flaps having a detent at a free end remote from the pivots and a run-up ramp positioned on a respective one of the end faces of the lateral case legs in the closed position of the wing whereby the detents are out of engagement with the pins in said position, and the flaps freely pivoting when the auxiliary frame and the pins fastened thereto are lifted off the end faces whereby the detents of the flaps are coupled to the pins to permit the wing and auxiliary frame to be pivoted in unison into the swing position.

2. The skylight of claim 1, wherein the locking device operative to position the wing in relation to the auxiliary frame and to lock the wing to the case in the closed position comprises a positioning linkage built into the wing, a latch housing affixed to the auxiliary frame for engagement by the linkage, and an operating handle on the wing for actuating the linkage to engage the latch housing for positioning the wing in relation to the auxiliary frame for permitting the wing and the auxiliary frame to be pivoted in unison, the coupling of the flap detents to the pins permitting the pivoting of the wing and the auxiliary frame in unison when the locking device fails.

3. The skylight of claim 1, wherein the flaps have an abutment face remote from the free ends thereof for engagement with the auxiliary frame.

4. The skylight of claim 1, wherein the pivots for the flaps are bolts fastened to the auxiliary frame and the flaps are freely movably mounted on the bolts.

5. The skylight of claim 1, wherein the flaps are of synthetic resin.

* * * * *